United States Patent [19]

Beatty, Jr. et al.

[11] 4,295,025

[45] Oct. 13, 1981

[54] CIRCUIT BREAKER WITH ELECTROMECHANICAL TRIP MEANS

[75] Inventors: William E. Beatty, Jr., Beaver Falls; James P. Ellsworth, Beaver, both of Pa.

[73] Assignee: Westinghouse Electric Corp., Pittsburgh, Pa.

[21] Appl. No.: 156,961

[22] Filed: Jun. 6, 1980

[51] Int. Cl.[3] ..... H01N 3/60; N01N 9/20

[52] U.S. Cl. ..... 200/288; 200/153 H; 200/301; 200/319

[58] Field of Search ..... 200/153 H, 153 G, 153 SC, 200/288, 154, 318, 319, 320, 361; 335/21

[56] References Cited

U.S. PATENT DOCUMENTS

| | | | |
|---|---|---|---|
| 2,866,031 | 12/1958 | Findley | 200/153 H |
| 3,783,423 | 1/1974 | Mater et al. | 335/174 |
| 3,826,951 | 7/1974 | Mater et al. | 317/33 SC |
| 3,835,277 | 9/1974 | Skreiner | 200/153 H |
| 4,114,005 | 9/1978 | Maier et al. | 200/288 |

FOREIGN PATENT DOCUMENTS

| | | | |
|---|---|---|---|
| 985723 | 3/1976 | Canada | 200/153 H |
| 1061418 | 7/1959 | Fed. Rep. of Germany | 200/153 H |

*Primary Examiner*—Willis Little

*Attorney, Agent, or Firm*—Benjamin Hudson, Jr.

[57] ABSTRACT

This invention provides a circuit breaker comprising separable contacts, a releasable mechanism, releasable to effect a tripping operation automatically opening the contacts and an electromechanical trip means operable to release the mechanism. A shock absorbing means is also provided that effectively isolates the flux transfer and magnetic trip actuator from shock and vibration.

1 Claim, 3 Drawing Figures

CIRCUIT BREAKER WITH ELECTROMECHANICAL TRIP MEANS

BACKGROUND OF THE INVENTION

1. Field of the Invention

This invention relates generally to circuit breakers of the type comprising a releasable mechanism, releasable to trip the breaker and an electromechanical trip means operable to effect release of the releasable mechanism.

2. Description of the Prior Art

In the patents of Alfred E. Maier, and John A. Wafer, U.S. Pat. No. 3,783,423, issued Jan. 1, 1974 and the patent of Alfred E. Maier and Allan B. Shimp, U.S. Pat. No. 3,826,951, issued July 30, 1974, there is disclosed circuit breakers having flux transfer magnetic trip actuators of the type comprising an armature structure releasable to trip the breaker and a permanent magnetic means operating to maintain the armature structure in an initial non-tripping position. Inasmuch as the detailed description of a circuit breaker having flux transfer magnetic trip actuators is disclosed in the aforementioned patents to which reference is made for complete description of structure and operation, the description of those portions is limited to the parts that are essential to the operation of the invention disclosed herein.

Flux transfer magnetic trip actuators are designed to trip the circuit breaker when it receives a low power electronic signal from its sensing circuit that indicates an overcurrent condition in one of the three phases of the circuit breaker. The sensitivity designed into flux transfer magnetic trip actuators has made them affected by shock and vibration created on the normal operation of the circuit breaker. When the circuit breaker is manually opened from its closed position to its off position, tremendous internal forces are released causing shock and vibration that is transmitted to the flux transfer magnetic trip actuator. This shock and vibration has a tendency to release the armature of the flux transfer magnetic trip actuator sending the circuit breaker into its trip position. This can cause problems when the circuit breaker is being monitored by other electrical apparatus that receives a signal from the circuit breaker when it is in its trip position. Thus, a problem is created when it is desired to manually turn off the circuit breaker but due to shock and vibration, the circuit breaker may go into its tripped state and therefore give false indications of overload conditions that may not exist.

SUMMARY OF THE INVENTION

This invention provides a circuit breaker comprising separable contacts, a releasable mechanism, releasable to affect a tripping operation automatically opening the contacts and a flux transfer magnetic trip actuator operable to release the mechanism. A shock absorbing spring is also provided that effectively isolates the flux transfer and magnetic trip actuator from shock and vibration created within the circuit breaker caused when the circuit breaker is manually operated from its closed to its open position. This shock absorbing means effectively prevents the circuit breaker from giving a false over-current indication when the circuit breaker is manually operated from its closed to its open or off position.

DESCRIPTION OF THE PREFERRED EMBODIMENT

Figure 1:
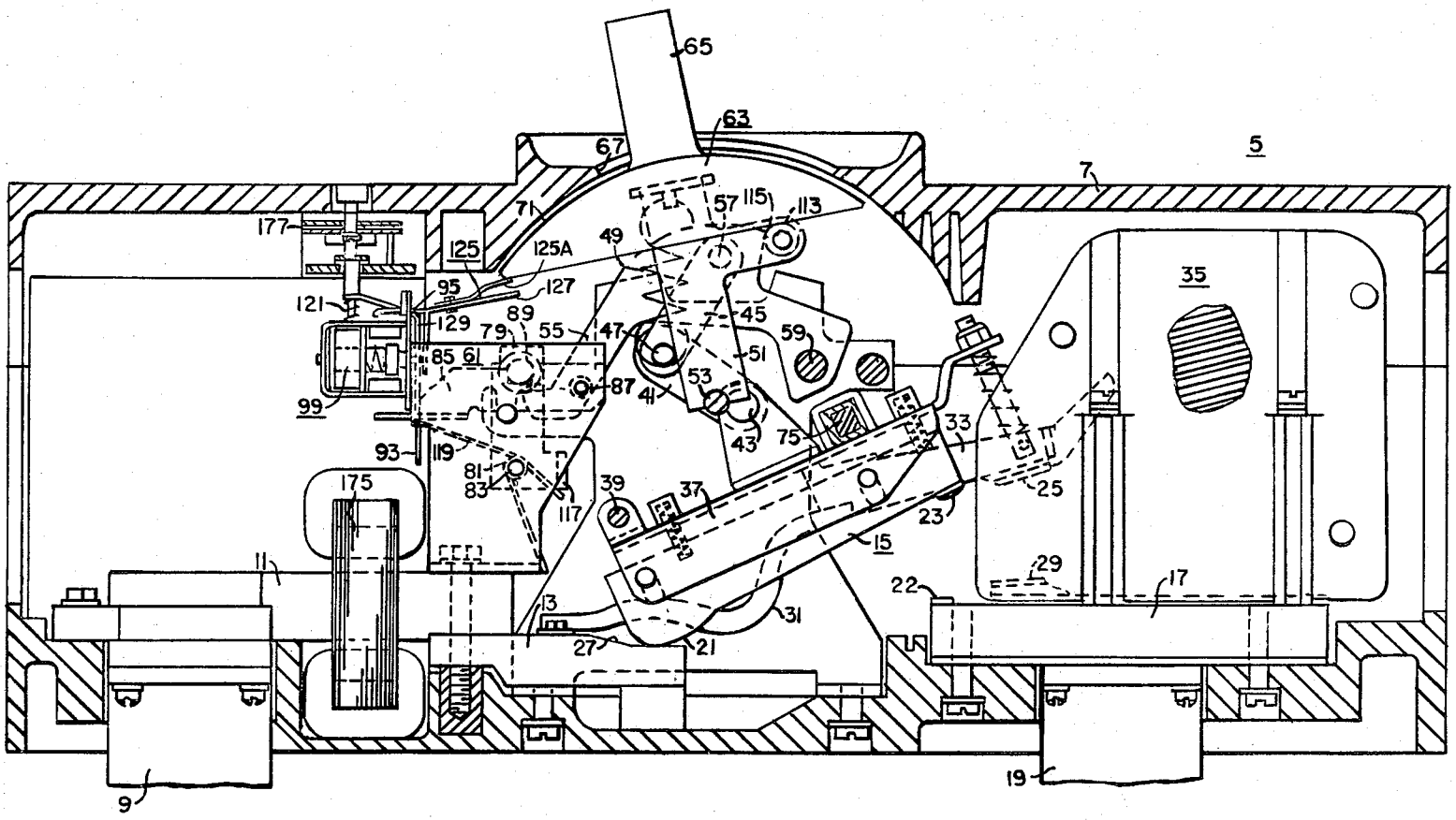
FIG. 1 is a side sectional view, with parts broken away, of the center pole unit of a three-pole circuit breaker constructed in accordance with the principles of this invention.

Referring to the drawings, there is shown in FIG. 1 the center pole unit of a three pole molded case type circuit breaker 5. The circuit breaker mechanism is more specifically described in the above-mentioned patent applications. Thus, only a brief description of the circuit breaker mechanism is provided herein. The circuit breaker 5 comprises an insulating housing 7 and a suitable barrier means that separates the housing into three adjacent insulating compartments for housing the three pole units of the three pole circuit breaker in a well-known manner. In the closed position of the circuit breaker, a circuit through each pole unit extends from a terminal 9 through a conductor 11, a conductor 13, a movable contact structure indicated generally at 15, a conductor 17, to another terminal 19. Contacts 21, 23 and 25 on the movable contact structure 15 cooperate with stationary contacts 27, 22 and 29, respectively, to bridge the conductors 13, 17 in the closed position of the movable contact structure 15. A flexible conductor 31 electrically connects the conductor 13 and a movable contact arm 33, that supports the arcing contacts 25. During opening operations of the movable contact structure 15, the arcing contact 25 separates from the stationary arcing contact 29 last to draw arcs in an arc extinguishing structure indicated generally at 35. The movable contact structure 15 is supported on a contact carrier 37 that is supported for pivotal movement on a pin 39. A lower toggle link 41 is pivotally connected to the contact carrier 37 at the lower end thereof by means of a pivot pin 43. The lower toggle link 41 is pivotally connected to an upper toggle link 45 by means of a knee pivot pin 47. A pair of over-center tension springs 49 are connected at the lower ends thereof to the knee pivot 47 of the toggle link 45 and at the upper ends thereof to the bight portion of an operating lever 51. The operating lever 51 is an inverted generally U-shaped lever that is supported on the inner ends of the legs thereof for pivotal movement about a pair of pins 53. The upper toggle link 45 is pivotally connected to a releasable member 55 by means of a pivot pin 57. The releasable member 55 is supported for pivotal movement at one end thereof on a pin 59 and is latched at the other end thereof by means of a latch structure indicated generally at 61. A handle structure indicated generally at 63 is connected to the upper end of the operating lever 51 and comprises a handle part 65 that protrudes through an opening 67 in the front of the housing 7 to permit manual operation of the circuit breaker. The handle structure 63 also comprises a shroud part 71 that substantially closes the opening 67 in all positions of the handle structure 63.

The circuit breaker is shown in FIG. 1 in the open position with the releasable trip member 55 latched in the latch position by means of a latch structure 61. In order to close the circuit breaker, the handle 65 is moved in a clockwise direction from the off position to an on position to move the operating lever 51 clockwise about the pivot 53. During this movement, the springs 47 are moved overcenter to erect the toggle 41, 45 to thereby pivot the movable contact carrier 37 of the center pole unit in a clockwise direction about the pivot pin 39 to move the movable contact structure 15 into the closed position. Since all of the contact carriers 37 of the three pole units are connected for simultaneous movement by means of a rigid insulating tie bar 75, this movement simultaneously closes the contact structure of all three pole units. In order to manually open the circuit breaker, the handle structure 63 is moved counterclockwise to the off position seen in FIG. 1. This moves the springs 49 overcenter to cause collapse of the toggle 41, 45 to thereby pivot the three contact carriers 37 about the pivot pins 39 in a counterclockwise direction to the open position shown in FIG. 1.

Figure 2:
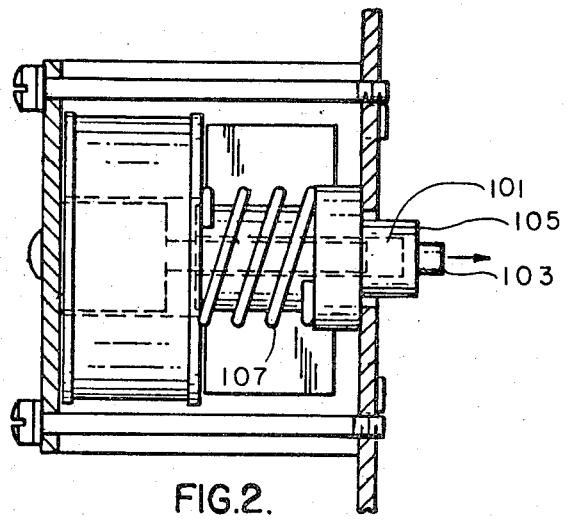
FIG. 2 is a side sectional view with parts broken away of the flux transfer magnetic actuator in its tripped state.
Figure 3:
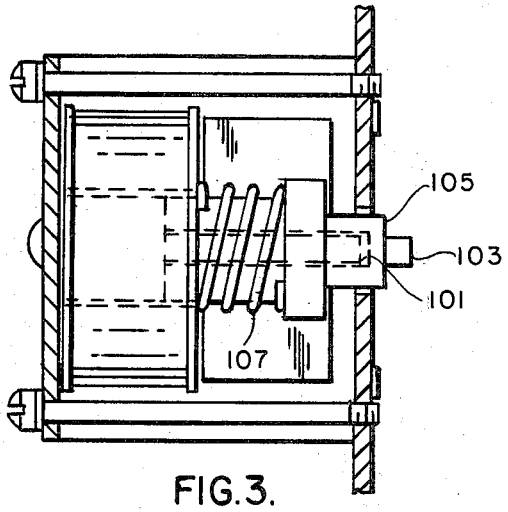
FIG. 3 is a side sectional view of the flux transfer magnetic actuator in its initial state.

The free end of the releasable member 55 is engaged under a roller member 79 that is mounted on a first latch member 81 that is pivotally supported on a fixed pivot pin 83. A second latch member 85, that is supported for pivotal movement on a pair of space pins 87 (only one of which is seen in FIG. 1) comprises a pair of arm legs that engage a pair of second rollers 89 that are supported on the first latch member 81 to latch the first latch member 81. A third latch member 93 is supported for pivotal movement about an axis indicated at 95. Latch member 81 comprises a window opening that receives a projection on a second latch member 85 to latch the second latch member 85 in a latch position seen in FIG. 1. A flux transfer magnetic trip actuator indicated generally at 99 is provided to affect tripping operations of the circuit breaker. Upon the occurrence of an overload current in any one of the three pole units of the circuit breaker. The magnetic trip actuator 99 comprises an armature 101 (FIGS. 2 and 3) that comprises a projection 103 and a shoulder 105. When the armature 101 is released a spring 107 moves the armature from the initial position seen in FIG. 3 to the actuator or trip position seen in FIG. 2. During this movement, the projection 103 moves through an opening in the third latch member 93, FIG. 1, and the shoulder portion 105 engages the third latch member 93 to pivot the third latch member 93 in a counterclockwise direction about the axis 95 thereof. With the circuit breaker in the closed position and the toggle 41, 45 in the erected position, the springs 49 are in a charged condition, and the movement of the latch member 93 to the unlatching position will release the latch structure 61 to release the releasable member 55 whereupon the charge springs 49 will collapse the toggle 41, 45 to trip the breaker. Upon movement of the third latch member 93 to the unlatched position, the second latch member 85 and first latch member 81 will be free to move to an unlatched position. The charge springs 49, operating against the releasable member 55, biasing the releasable member 55 in a clockwise direction about the pivot 59, will force the releasable member 55 clockwise to force the first latch member 81 counterclockwise to force the second latch member 85 counterclockwise. The releasable member 55 will move clockwise changing the line of action of the overcenter springs 49 whereupon the springs 49 will collapse the toggle 41, 45 and move the contact carriers 37 of the three pole units to a trip open position. This movement will move the handle structure 63 to a position intermediate the on and off positions to provide a visual indication that the circuit breaker has been tripped.

Following a tripping operation, it is necessary to reset and relatch the mechanism before the circuit breaker can be closed. In order to reset the circuit breaker, the handle structure 63 is moved counterclockwise from the intermediate position to a reset position past the off position as shown in FIG. 1. During this movement, a pin portion 113 on the operating lever 51 engages a shoulder 115 on the releasable member 115 to rotate the releasable member 115 in a counterclockwise direction whereupon the free end of the releasable member engages a part 117 of the first latch member 81 to pivot the first latch member 81 in a clockwise direction about the pivot pin 83 to a reset position whereupon spring means 119 biases the second latch member 85 to the latching position and spring means 121 biases the third latch member 93 to the latching position. During the resetting operation, the handle structure 63 is moved to the reset position which reset position is almost to the limit of the movement of the operating above-mentioned handle structure 63 and the opening 67. During this movement, the shroud 81 on the handle structure 63 engages a leaf spring member **125*a* that will be discussed in more detail later, a reset member 125 that comprises a horizontal arm 127 and a generally vertical arm 129. The reset member 125 is supported for pivotal movement about the axis 95. Upon movement of the handle structure 63 to the reset position, the shroud 71, engaging the arm 127 of the reset member 125, pivots the reset member 125 a clockwise direction, see FIG. 1, (whereupon the arm 129, operating against the projection 103 shown in FIG. 3) of the magnetic trip actuator 99, moves the armature 101 from the actuator or tripping position seen in FIG. 2 to the initial or reset position seen in FIG. 3** whereupon the magnetic trip actuator is reset and will be maintained in the reset position. Following a resetting operation, the circuit breaker can be operated in the same manner as was hereinbefore described.

It has been discovered that when the handle structure 63 is moved counterclockwise to the off position seen in FIG. 1, the movement of the springs 49 overcenter to cause collapse of the toggle 41, 45 to thereby pivot the three contact carriers 37 about pivot pins 39 in a counterclockwise direction to the open position creates shock and vibration within the circuit breaker unit. This shock and vibration has a tendency to cause the armature 101 of the flux transfer magnetic trip actuator to prematurely trip the circuit breaker to the trip state. This may be undesirable when the circuit breaker is connected to a monitoring system whereby an indication of overcurrent condition is falsely sent to other control apparatus as a result of the circuit breaker being in its tripped state instead of its off position. To prevent this occurrence, the leaf spring **125*a* is connected to the reset member 125 so that the shroud 71 of the handle structure 63** engages the leaf spring as the handle structure goes from the on position to the off position and the spring absorbs the shock and vibration that may be created and prevents premature tripping of the flux transfer magnetic trip actuator.

It can be readily seen that this application provides a new and improved circuit breaker design utilizing flux transfer magnetic trip actuator and greatly eliminates the adverse affects of shock and vibration and provides a more reliable circuit interrupter.

What we claim is:

1. A circuit interrupter, comprising:

(a) housing means;

(b) contact means disposed within said housing means for being actuated to an opened state;

(c) manual actuating means disposed in said housing means to be moved to actuate said contact means;

(d) electromechanical trip means disposed in said housing means to be electromechanically moved to actuate said contact means and to provide an associated trip indication; and (e) shock absorbing means generally comprised of a leaf spring connected to said electromechanical trip means so it is disposed to absorb the shock and vibration when said manual actuating means is manually operable to open and close said contacts.

* * * * *